US008225721B2

(12) United States Patent
Hunter

(10) Patent No.: US 8,225,721 B2
(45) Date of Patent: Jul. 24, 2012

(54) APPARATUS AND METHOD FOR SECURING A RAILCAR SANITARY COVER

(76) Inventor: Mark Hunter, Fitzgerald, GA (US)

( * ) Notice: Subject to any disclaimer, the term of this patent is extended or adjusted under 35 U.S.C. 154(b) by 332 days.

(21) Appl. No.: 12/496,256

(22) Filed: Jul. 1, 2009

(65) Prior Publication Data

US 2011/0000395 A1 Jan. 6, 2011

(51) Int. Cl.
*B61D 39/00* (2006.01)

(52) U.S. Cl. ..... 105/377.07; 105/377.06

(58) Field of Classification Search ..... 105/377.01, 105/377.05, 377.06, 377.07
See application file for complete search history.

(56) References Cited

U.S. PATENT DOCUMENTS

| | | | | |
|---|---|---|---|---|
| 1,316,713 | A | 9/1919 | Guay | |
| 1,494,745 | A * | 5/1924 | Griffin et al. | 220/254.4 |
| 1,533,862 | A | 5/1924 | Hyle | |
| 1,634,029 | A * | 6/1927 | Korkames | 220/816 |
| 1,896,330 | A * | 2/1933 | Ruppel | 220/816 |
| 2,073,513 | A | 3/1937 | Dietrichson | |
| 2,201,826 | A | 5/1940 | Ditchfield | |
| 2,295,909 | A * | 9/1942 | Massey | 248/147 |
| 3,262,227 | A * | 7/1966 | Pentecost | 49/354 |
| 3,314,444 | A | 4/1967 | White | |
| 3,368,500 | A * | 2/1968 | Raab et al. | 105/377.06 |
| 3,639,007 | A | 2/1972 | Dare et al. | |
| 3,692,363 | A | 9/1972 | Tenebaum et al. | |
| 3,997,089 | A | 12/1976 | Clarke et al. | |
| 4,046,416 | A | 9/1977 | Penner | |
| RE29,816 | E | 10/1978 | Winsor et al. | |
| 4,207,020 | A | 6/1980 | Schuller | |
| 4,248,160 | A | 2/1981 | Carney et al. | |
| 4,655,365 | A | 4/1987 | Miller | |
| 4,809,873 | A | 3/1989 | Fossey | |
| 5,531,541 | A * | 7/1996 | Clover et al. | 404/25 |
| 5,690,141 | A * | 11/1997 | Creaghe | 137/382 |
| 6,095,365 | A * | 8/2000 | Yielding | 220/264 |
| 6,142,082 | A | 11/2000 | Burke et al. | |
| 6,506,563 | B1 | 1/2003 | Ward et al. | |
| 7,341,398 | B2 * | 3/2008 | Johnson et al. | 404/25 |
| 7,367,271 | B2 | 5/2008 | Early | |
| 7,658,570 | B2 * | 2/2010 | Hill et al. | 404/25 |
| 7,661,371 | B2 * | 2/2010 | Wyler | 105/377.07 |
| 7,695,213 | B1 * | 4/2010 | Akkala et al. | 404/25 |
| 7,770,526 | B2 * | 8/2010 | Drager | 105/377.07 |
| 7,832,958 | B2 * | 11/2010 | Veldboom et al. | 404/25 |
| 2005/0244227 | A1 * | 11/2005 | Akkala et al. | 404/25 |
| 2009/0158959 | A1 * | 6/2009 | Schultz et al. | 105/377.07 |
| 2010/0107926 | A1 * | 5/2010 | Drager | 105/377.07 |
| 2011/0000395 | A1 * | 1/2011 | Hunter | 105/280 |

* cited by examiner

*Primary Examiner* — S. Joseph Morano
*Assistant Examiner* — Jason C Smith
(74) *Attorney, Agent, or Firm* — Gardner Groff Greenwald & Villanueva

(57) ABSTRACT

An apparatus for securing a cover to a bottom outlet valve (BOV) of a railcar, where the apparatus has a bracket attached to the railcar proximate the BOV; a rod extending generally perpendicularly from the bracket; and a cantilevered arm extending from the rod near a distal end thereof, where the cantilevered arm is configured to support the cover.

20 Claims, 7 Drawing Sheets

APPARATUS AND METHOD FOR SECURING A RAILCAR SANITARY COVER

TECHNICAL FIELD

The present invention relates generally to the field of railcars, and more particularly to an apparatus and method for securing sanitary covers to carbon black railcars.

BACKGROUND OF THE INVENTION

For nearly two hundred years transporting refined materials and raw materials by railcar has been a popular mode of transportation. This mode of transportation continues to be especially popular when transporting cargo to and from ships or when transporting bulk materials from one inland site to another inland site. Numerous types of railcars, including but not limited to, boxcars, refrigerated boxcars, flatcars, tankers, container carriers, gondolas, hoppers, and auto transporter have been designed and used to transport various types of cargo that include refined and raw materials.

One popular railcar for transporting these materials is the carbon black railcar. The carbon black railcar is a specialized hopper car, which is used to transport dry bulk commodities. These commodities include grains, industrial minerals, plastic pellets, crushed rock, gravel, and sand. In general, these cars are loaded with commodities through the top of the railcar and are unloaded through bottom outlet valves (BOVs) on the bottom of the railcar.

These railcars are typically equipped with a BOV and a hatch cover to secure the railcar's cargo and to prevent spillage. In addition, a sanitary cover is typically mounted over the BOV and affixed via valve cover locks and a chain to the railcar. These sanitary covers prevent or reduce contamination of the railcar's cargo either during loading, during transport, or when the railcar is idle but loaded with cargo. However, when not in use, the chains securing the sanitary covers can catch on the tracks. When such occurs, the sanitary cover usually dislodges and is lost.

SUMMARY OF THE INVENTION

Described herein is an apparatus and method for securing a cover to a bottom outlet valve (BOV) of a railcar. In one aspect, the cover is a sanitary cover. These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Described herein is an apparatus and method for securing a sanitary cover to a BOV of a railcar. In one aspect, the apparatus is a bracket assembly that attaches a sanitary cover to the railcar BOV in its use, active, or closed position (i.e., covering the outlet or hatch) and in its non-use, inactive, or open position (i.e., not covering the outlet or hatch).

The railcar includes, but is not limited to, a boxcar, a refrigerated boxcar, a flatcar, a tanker, a container carrier, a gondola, and a hopper. In an example embodiment, the railcar is a hopper car, which is designed to secure and transport cargo. The railcar hopper cargo can include, but is not limited to, grains, industrial minerals, carbon blacks, silica, fumed silica, plastic pellets, crushed rock, gravel, and sand. In this aspect, the hopper car is a carbon black railcar.

Figure 1:
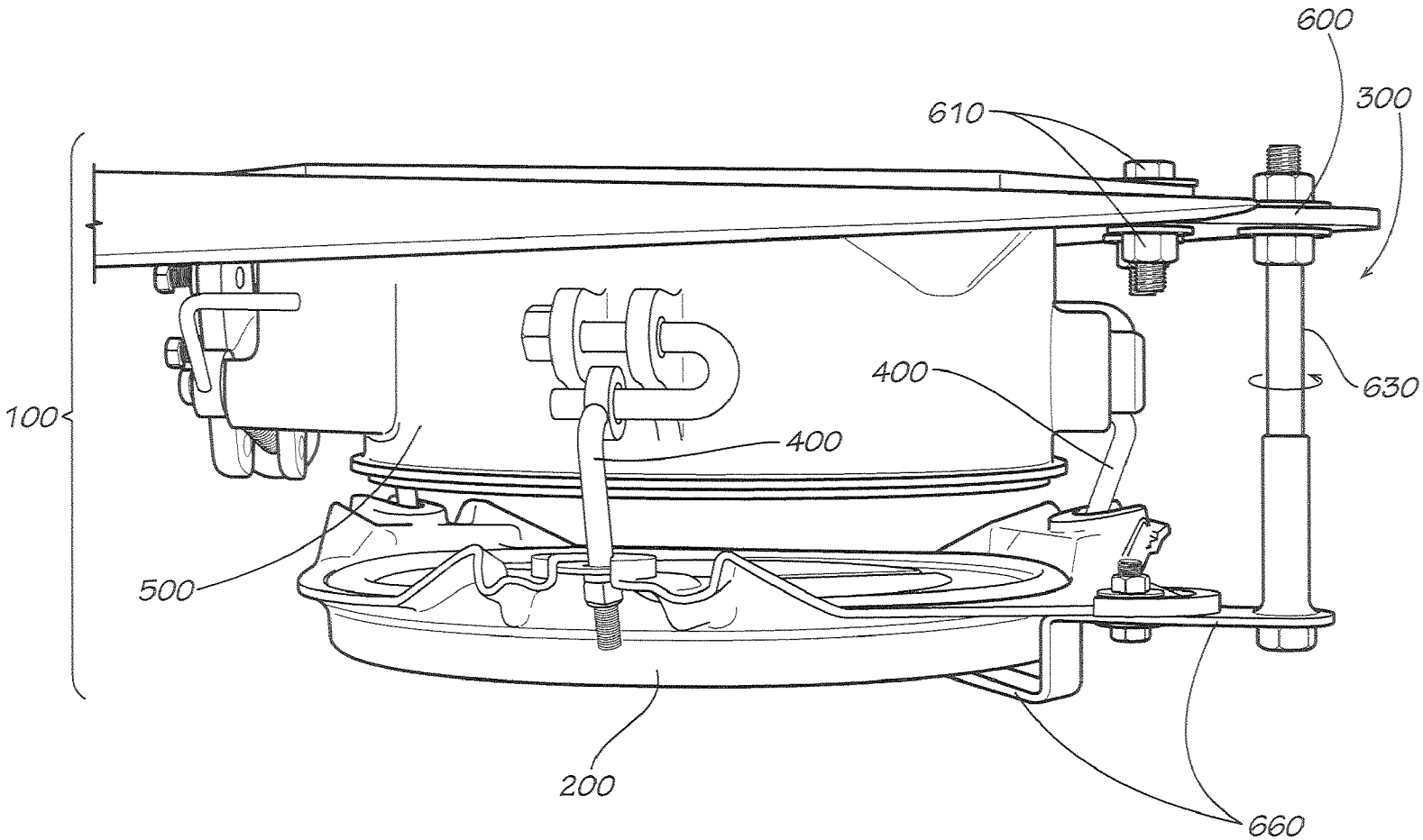
FIG. 1 shows a perspective view of a bracket assembly for securing a sanitary cover to a BOV of a railcar according to an example embodiment of the present invention.
Figure 2:
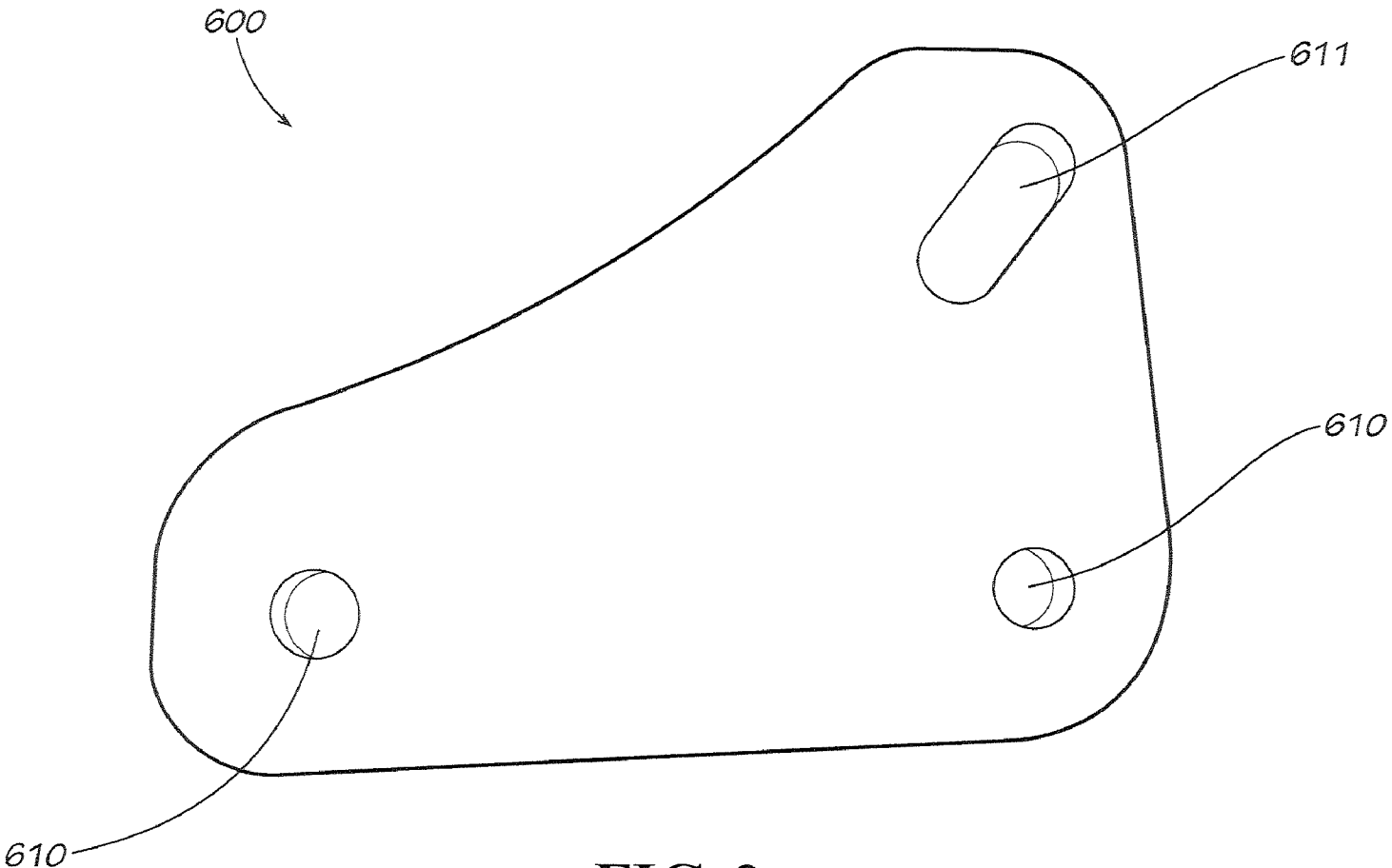
FIG. 2 shows a top view of a bracket plate of the bracket assembly of FIG. 1.

Typically, the hopper car includes one or more BOVs/hoppers that are closed by one or more hatch covers, which secure and prevent spillage of the car's cargo. One such BOV is shown in FIG. 1, in which a sanitary cover and a bracket assembly are shown with the BOV (generally 100). The car can be equipped with a sanitary cover 200 which fits directly over the BOV hatch cover and is secured thereto with one or more valve locks 400 when in use. When the sanitary cover 200 is not in use, it can be stored in close proximity of the hatch cover. The sanitary cover 200 generally prevents or reduces contamination of the cargo either during transport or when the car is in a stationary position.

With reference now to the drawing figures, wherein like reference numbers represent corresponding parts throughout the several views, FIGS. 1 and 2-7 show an apparatus or bracket assembly 300 for attaching a sanitary cover 200 to a railcar BOV 500 or a railcar hatch according to an example embodiment of the present invention. For example, the bracket assembly can attach a sanitary cover to a BOV of a carbon black railcar. The bracket assembly 300 includes a bracket or a plate 600 that attaches to the railcar, a rotational element such as a rod or shaft 630 secured to the bracket and extending generally perpendicularly to the plate, and a cantilevered arm 660 extending from a distal end of the shaft.

In the depicted embodiment, the bracket assembly is designed to retrofit railcars. In alternative embodiments, the bracket assembly can be manufactured concurrently with and directly attached to the railcar BOV. In this embodiment, the bracket or plate can be an optional feature such that shaft is directly welded or otherwise secured to the railcar. In still other embodiments, the shaft can be releasably and directly attached to the railcar without use of a bracket plate.

Referring back to FIGS. 1-6, the bracket 600 is a rigid plate attached directly to the railcar proximate the BOV 500. The bracket 600 can include at least one aperture 610 for attaching the bracket to the railcar gate/BOV with at least one fastener and at least one slot 611 for receiving a fastener end of the rod 630, as shown more clearly in FIG. 2. The at least one aperture 610 of the bracket can be aligned with at least one aperture of the railcar such that a fastener can be placed therethrough to secure the bracket, and hence the bracket assembly, to the railcar. The slot 611 can be optionally elongated to allow for easy adjustment and centering of the cover in relation to the hatch cover and railcar BOV. For example, the slot 611 can have dimensions of about ¾" to 1" in width by ¾" to 3" in length to allow for easy adjustment and centering of the sanitary cover 200 over the outlet gate/BOV. In another aspect, the slot 611 can have the dimensions of 13/16" in width by 2" in length to allow for easy adjustment and centering of the sanitary cover over the outlet gate/BOV. In the depicted embodiment, two apertures 610, for receiving two fasteners, are shown, although any suitable number of fasteners can be used to secure the bracket plate to the railcar. In such an embodiment, the bracket assembly is releasably secured to the railcar. In alternative embodiments, the bracket can be permanently or semi-permanently attached, bonded, welded, adhered, or otherwise affixed to the railcar.

Figure 3:
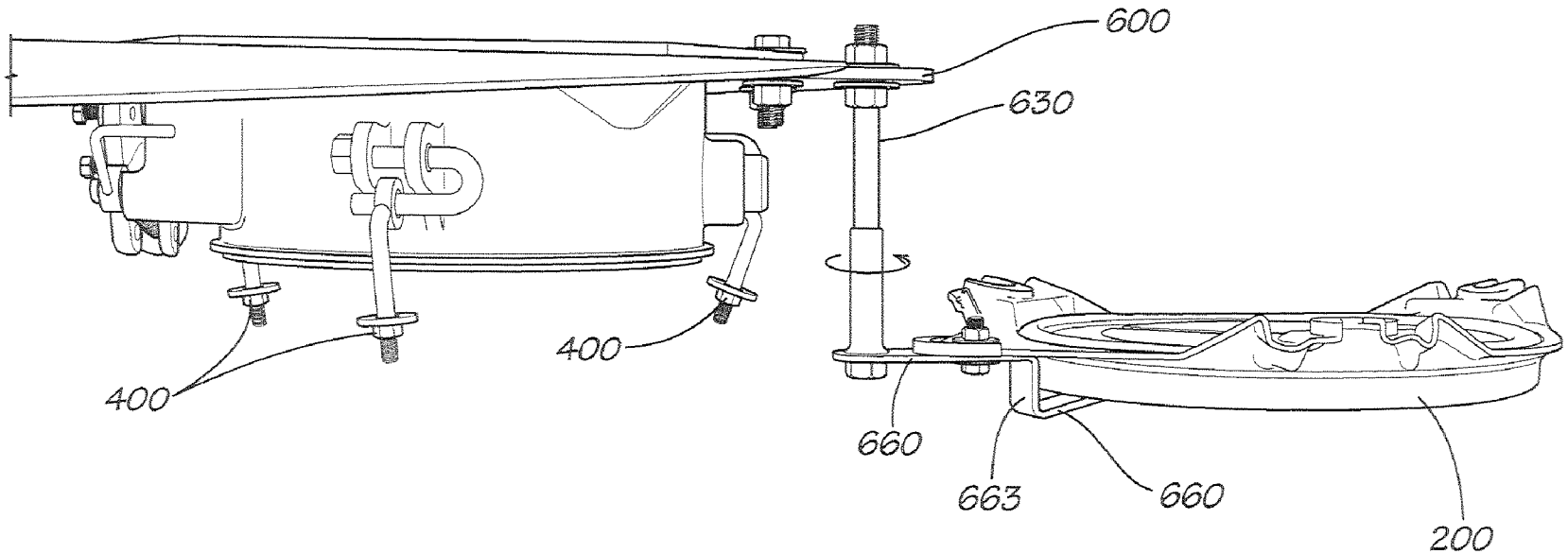
FIG. 3 shows a perspective view of the bracket assembly of FIG. 1 and showing the cover in an open position.

The rod 630 can include an outer sleeve 631 extending around a distal portion thereof. A cantilevered arm 660 configured to support the sanitary cover is secured to the outer sleeve of the rod near a distal end thereof. For example, the cantilevered arm can be welded or otherwise affixed to the outer sleeve. The outer sleeve is configured to allow the cantilevered arm 660 (and the sanitary cover 200 when attached thereto) to rotate away from the railcar BOV into an "open" position as shown in FIG. 3. Optionally, the sleeve can include a lock nut or other locking element and/or can be lined with a polymer substance. The lock nut can be used to lock the bracket assembly with the sanitary cover in its open position. The polymer substance can be used to prevent sleeve from freely moving about the rod when the sanitary cover is not locked against the gate/BOV.

In an alternative embodiment, the proximal end of the cantilevered arm can include a circular opening therethrough. The circular opening can have a diameter similar to the shaft. In such an embodiment, the shaft extends through the opening, and the arm is rotatable about the shaft. Optionally, one or more nuts, clamps, or the like can be used to lock the arm in its desired position.

In the depicted embodiment, the cantilevered arm has a shape that generally conforms to the contours of the sanitary cover. For example, the cantilevered arm can include multiple crimps 663 or bends so as to be "form fitting" for the sanitary cover, as best seen in the bottom perspective view of FIG. 5. In an alterative embodiment, the cantilevered arm can be a generally straight, linear beam, although any suitably shaped arm can be used to support the sanitary cover. Preferably, the length of the arm is long enough that it extends to at least the midpoint of the cover. In alternative embodiments, the length can be shorter or longer.

Figure 4:
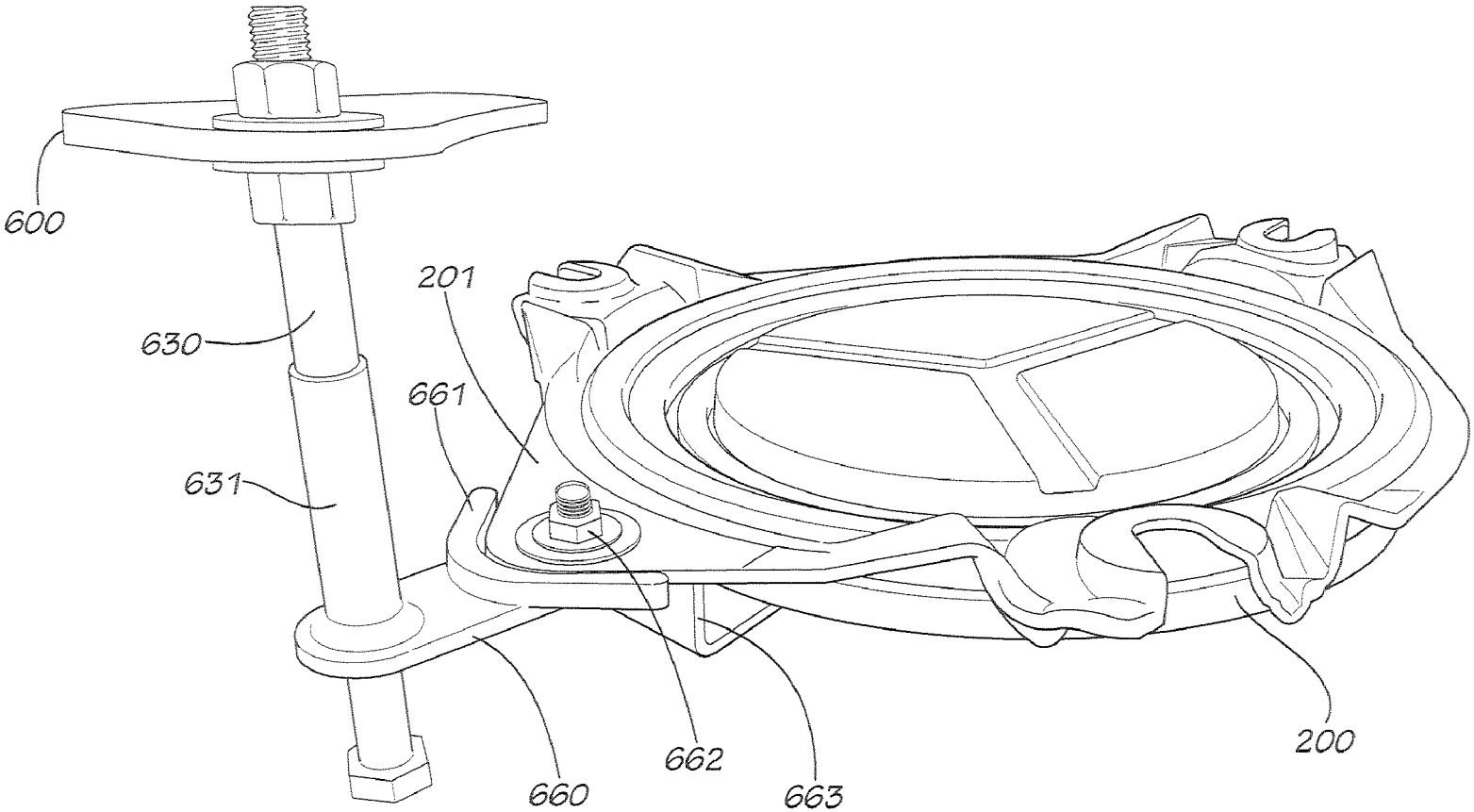
FIG. 4 shows a side perspective view of the bracket assembly of FIG. 1.
Figure 5:
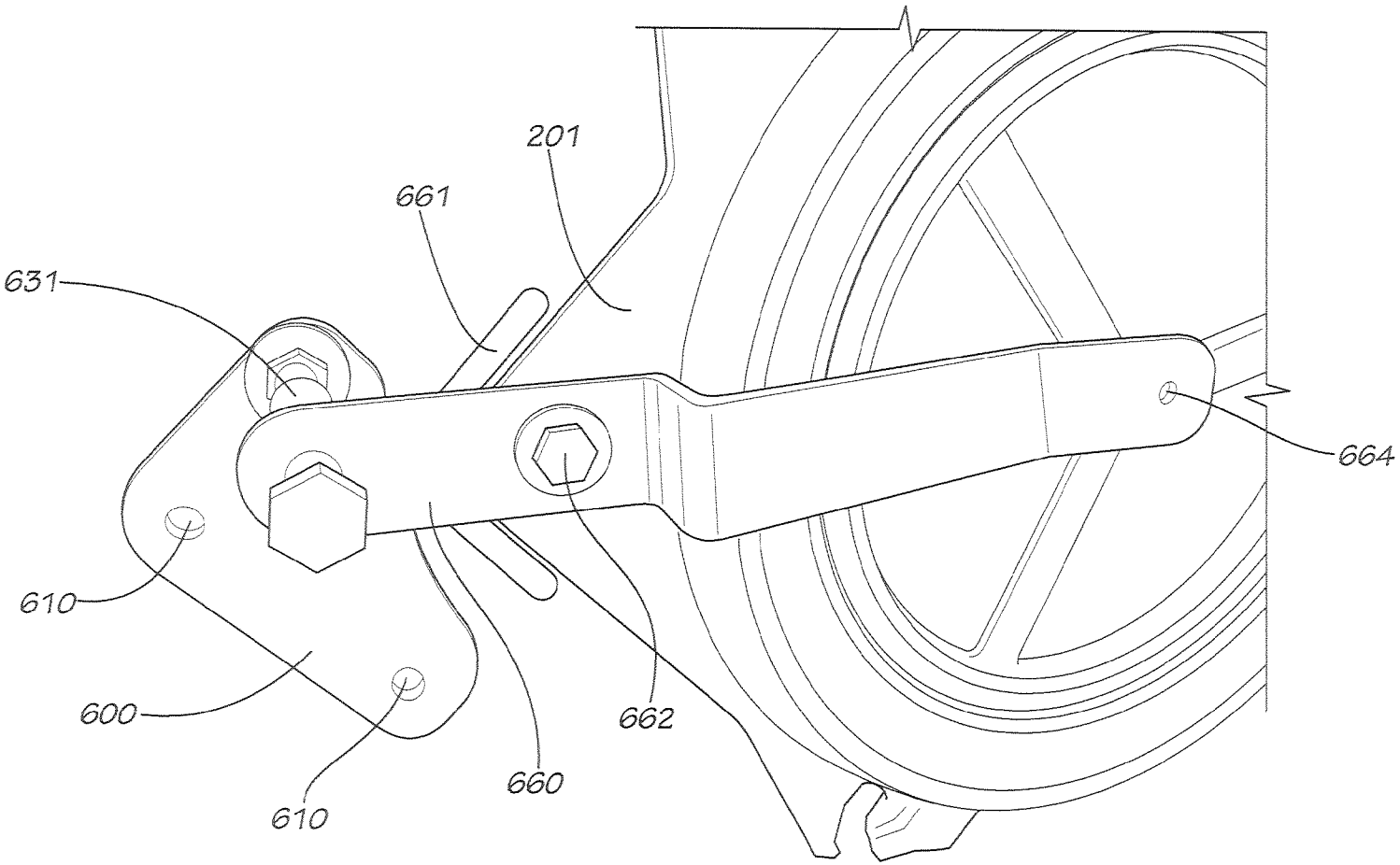
FIG. 5 shows a bottom perspective view of the bracket assembly of FIG. 1.
Figure 6:
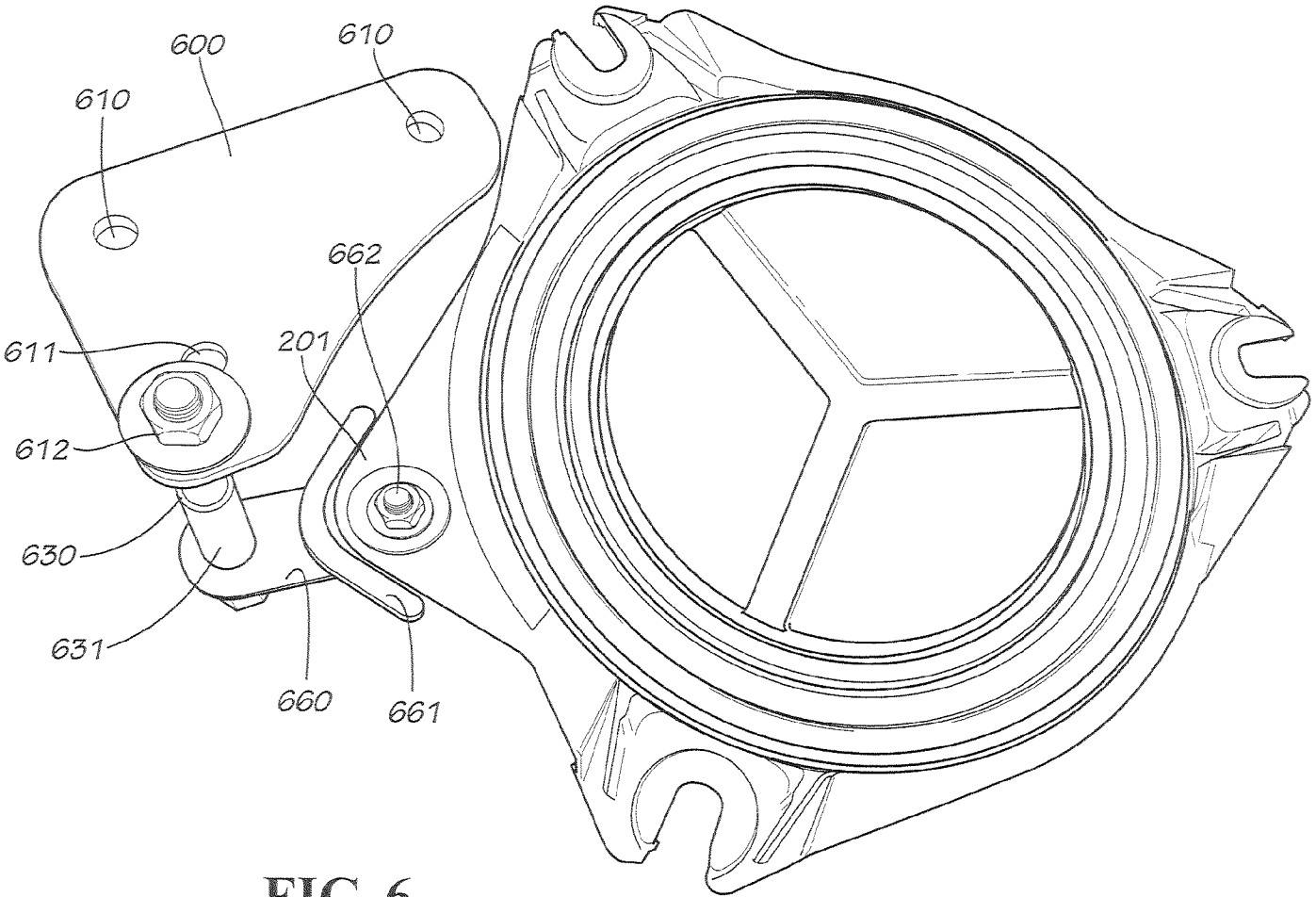
FIG. 6 shows a top perspective view of the bracket assembly of FIG. 1.

In the depicted embodiment, the cantilevered arm can include a yoke 661 that engages a lip portion or flange of the sanitary cover as shown more clearly in FIG. 4. Accordingly, the yoke 661 can be suitably sized and shaped to engage the lip or flange of the sanitary cover. The yoke 661 restricts lateral movement of the cover when the cover is attached to the arm. Additionally, the arm can include one or more fastener apertures. As best seen in FIGS. 4-7, the arm includes a first fastener aperture 662 near the yoke 661. The aperture 662 generally aligns with a hole in the lip portion of the sanitary cover (as is conventional with such sanitary covers). Thus, a fastener, such as a bolt, can be inserted through the aligned holes of the arm and the cover to secure the cover to the arm. Optionally, a second aperture 664 (as shown in FIG. 5) or an elongated aperture 665 (as shown in an alternative embodiment of FIG. 7) can be located near the distal end of the arm. The second aperture can align with a central hole of the sanitary cover (as some sanitary covers include a small hole at or near the center of the cover) and receive a second fastener therethrough to further secure the sanitary cover to the cantilevered arm. The dimensions of the apertures 662, 664, 665 located on the cantilevered arm can be readily varied. For example, the aperture on the distal end of the cantilevered can be modified to include a slot 665, as shown in the alternative embodiment of FIG. 7.

The various fasteners used to secure the bracket plate to the railcar and to secure the sanitary cover to the arm can include, but are not limited to, nuts and bolts, screws, nails, buttons, huck fasteners, and rivets.

Figure 7:
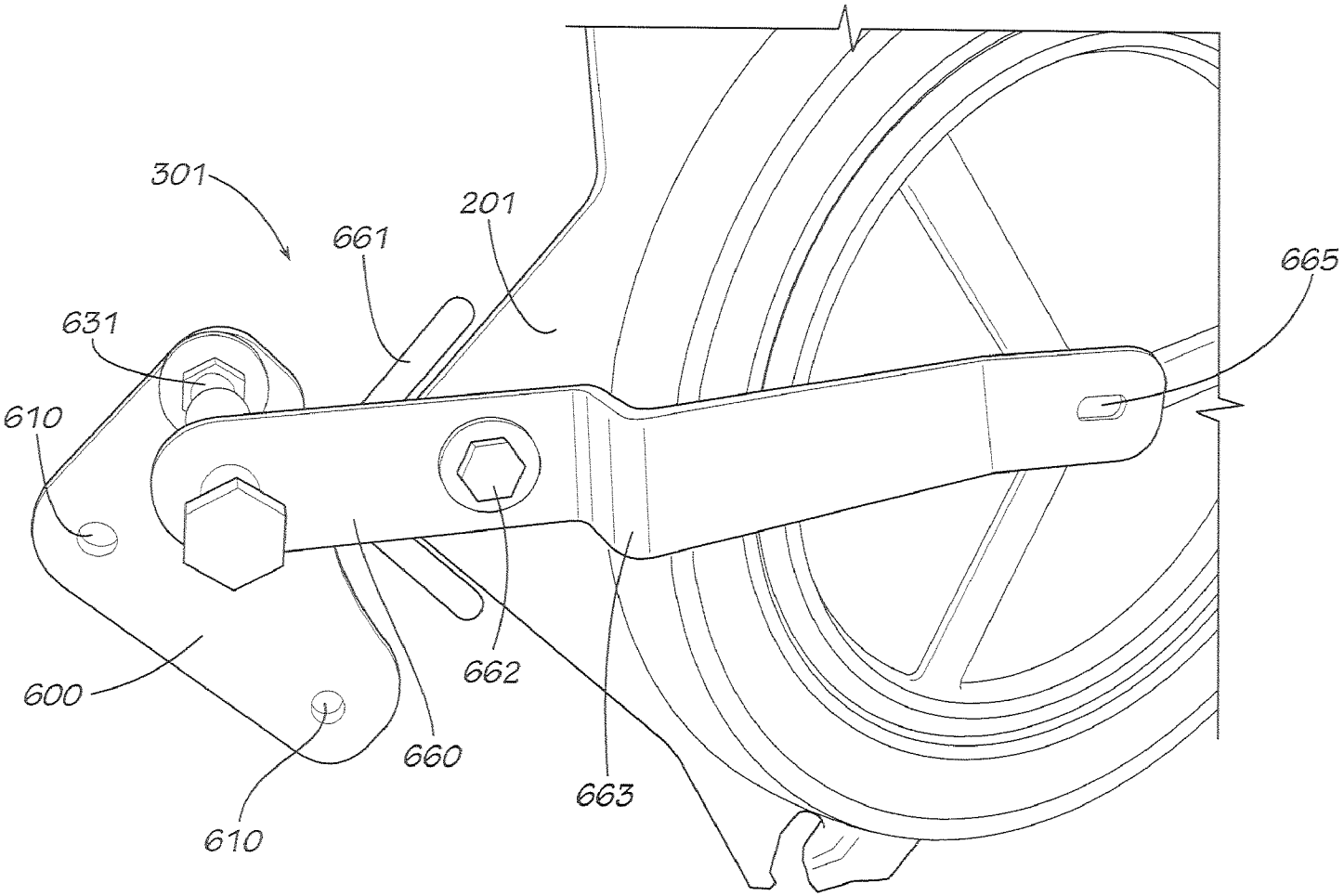
FIG. 7 shows a bottom perspective view of a bracket assembly for securing a sanitary cover to a BOV of a railcar according to another example embodiment of the present invention.

FIG. 7 shows a perspective bottom view of the bracket assembly according to another embodiment of the present invention. The bracket assembly 301 is substantially similar to the bracket assembly 300 with the exception that the distal end of the cantilevered arm includes an elongated aperture or slot 665. In one aspect, the aperture 665 is about ¼" to 1½" in length by about ¼" to ¾" in width, although in other embodiments, this aperture can be larger or smaller. In the depicted embodiment, the aperture 665 is about 1" in length by about 11/16" in width, although in other embodiments, this aperture can be larger or smaller. The aperture 665 provides adjustability such that at least portion of the slot aligns with a central hole of the sanitary cover.

The bracket assembly can vary in size and the various components can be made of various materials including metal, metal alloys, hard polymeric materials, wood, or any combination thereof. For example, the metal or metal alloy can include, but is not limited to, iron, titanium, cobalt, nickel, copper, tungsten, aluminum, tin, lead, an iron alloy, steel, a nickel alloy, an aluminum alloy, a titanium alloy, a cobalt alloy, a copper alloy, a tungsten alloy, or any combination thereof. In another aspect, the hard polymeric material can include, but is not limited to, a thermoplastic, a thermoresin, a polystyrene, a polyvinyl chloride, a polyamide, a polyacrylate, a polyethylene, a high density polyethylene, a low density polyethylene, a polypropylene, a polyethylene terpthalate or compounds containing a polystyrene, a polyvinyl chloride, a polyamide, a polyacrylate, a polyethylene, a high density polyethylene, a low density polyethylene, and a polypropylene or any combination thereof. In certain embodiments, the bracket assembly can be made of steel grades A36 to A572.

In certain embodiments, the bracket 600 can be between about ⅜" to about ¾" in thickness and between about 8" to about 12" in length. In this embodiment, the apertures 610 range from about 9/16" to about 11/16" in diameter and the slot 611 ranges from about ¾" to about 1" in width and about ¾" to about 3" in length. In one embodiment, the thickness of the bracket is about ⅜"; the apertures 610 are about 11/16" in diameter; and the slot 611 is about 13/16" in width and about 2" in length. In this embodiment, the overall length of the bracket 600 is about 8½". In certain embodiments, the bracket can be made of steel grades A36 to A572 although other suitable materials can be employed as well.

In certain embodiments, the rod 630 is about 8" to about 12" in length and has a diameter of about ¾" to about 1". In certain embodiments the rod 630 is secured to the bracket 600 by a washer and a bolt. The bolt can be made of grade 5 or grade 8 steel and have a diameter of about ¾" to about 1". If the outer sleeve 631 is present, it ranges from about 1" to about 1½" in diameter. In one embodiment, the yoke 661 is about ⅜" to about ¾" in width, about 5" to about 8" in length, and from about ¼" to about ¾" in thickness. In one embodiment, the rod 630 is about 8" in length and about ¾" in diameter. In this embodiment, bolt(s) and washer(s) secure the rod to the bracket. The bolt is grade 5 steel and is about ¾" in diameter; the washers are about ¾" in diameter. In this embodiment, the outer sleeve 631 is present and is about 1" in diameter. In this embodiment, the yoke 661 is about ½" in width, about 6½" in length, and about ⅜" thick. It should be noted that these dimensions are exemplary and that other sizes of the components in the bracket assembly are within the scope of the present invention.

In use, the sanitary cover can be temporarily, semi-permanently, or permanently secured to the railcar by the bracket assembly and methods described herein. More specifically, the sanitary cover can be secured to the rail car in both its use or closed position (when covering the BOV) and its non-use, open, or storage position. To retrofit an existing railcar, a user can secure the plate of a bracket assembly to the railcar proximate the outlet gate/BOV to be covered with a plurality of bolts or other fasteners.

The user can secure the sanitary cover to the cantilevered arm by placing the sanitary cover on cantilevered arm, aligning the fastener hole with a hole of the dust cover, and inserting a fastener through the aligned holes. Optionally, a second fastener can be inserted through the aperture or slot 664 or 665, through the central hole of the sanitary cover, and secured thereto. The user can rotate the cantilevered arm such that the sanitary cover aligns with the BOV. The user can adjust the placement of the sanitary cover by moving the shaft within the slot. When properly aligned the user tightens the nut on the fastener end of the shaft.

To cover the BOV and lock the sanitary cover thereto, the user can manipulate the one or more valve cover locks 400 of the BOV such that they engage and lock the sanitary cover thereto. To uncover the BOV and move the sanitary cover into the open position of FIG. 3, the user disengages the valve cover locks and rotates the cover away from the BOV and into an open position by rotating the cantilevered arm about the shaft.

While the invention has been described with reference to preferred and example embodiments, it will be understood by those skilled in the art that a variety of modifications, additions and deletions are within the scope of the invention, as defined by the following claims.

What is claimed is:

1. A bracket assembly for securing to a railcar a cover for a bottom outlet valve of the railcar, comprising:

a bracket attached to the railcar proximate the bottom outlet valve;

a rotational element extending from the bracket; and a cantilevered arm extending from and laterally rotational about the rotational element, wherein the cantilevered arm is mounted to the cover and configured to support the cover when the cover is not secured to the bottom outlet valve, wherein the cover rotates laterally between a use position covering, secured to, and below the bottom outlet valve and a storage position exposing the bottom outlet valve, wherein the rotational element is axially extendible and retractable, wherein when the cover is in the use position the rotational element is retracted and the cover is secured against the bottom outlet valve and in the storage position the rotational element is extended so that the cover is separated from the bottom outlet valve.

2. The bracket assembly of claim 1, wherein the rotational element includes a rod, and the cantilevered arm is rotatable about the rod.

3. The bracket assembly of claim 2, wherein the rod includes an outer sleeve and wherein the cantilevered arm is secured to the outer sleeve.

4. The bracket assembly of claim 1, wherein the cantilevered arm includes a yoke and wherein the yoke engages a lip of the cover.

5. The bracket assembly of claim 4, wherein the cantilevered arm includes a fastener hole proximate the yoke for receiving a fastener therethrough to mount the cantilevered arm to the sanitary cover.

6. The bracket assembly of claim 1, wherein the cantilevered arm extends from the rotational element near a first proximal portion of the cantilevered arm mounts to the cover near a second distal portion of the cantilevered arm.

7. The bracket assembly of claim 1, wherein the rotational element includes a rod that extends generally perpendicularly from the bracket.

8. The bracket assembly of claim 1, wherein the bottom outlet valve includes at least one lock adapted to secure the cover in the use position, wherein in the use position the cover is supported by the lock.

9. A bracket assembly for securing to a railcar a cover for a bottom outlet valve of the railcar, comprising:

a bracket attached to the railcar proximate the bottom outlet valve;

a rotational element extending from the bracket; and a cantilevered arm extending from and laterally rotational about the rotational element, wherein the cantilevered arm is mounted to the cover and configured to support the cover when the cover is not secured to the bottom outlet valve, wherein the cover rotates laterally between a use position covering, secured to, and below the bottom outlet valve and a storage position exposing the bottom outlet valve, and wherein the bracket includes an elongated slot for receiving a fastener end of the rotational element therethrough and wherein at least a portion of the slot is alignable with an aperture of the railcar to mount the bracket to the railcar.

10. A bracket assembly for attaching a sanitary cover for a bottom outlet valve of a carbon black railcar by a plurality of fasteners, comprising:

a bracket, wherein the bracket is a rigid plate secured to the railcar proximate the bottom outlet valve, wherein the bottom outlet valve is removably secured to the railcar with one or more of the fasteners;

an elongated shaft extending vertically from the plate; and a cantilevered arm extending from the elongated shaft, wherein the cantilevered arm is removably attached to the sanitary cover with two or more of the fasteners, wherein the cantilevered arm includes a first fastener hole near a proximal end thereof and a second fastener hole near a distal end thereof.

11. The bracket of claim 10, wherein the plate includes one or more apertures for receiving one or more of the fasteners.

12. The bracket of claim 11, wherein the at least one aperture includes a slot.

13. The bracket assembly of claim 10, wherein the plate, the shaft, and the cantilevered arm are constructed of metal.

14. The bracket assembly of claim 10, wherein the cantilevered arm includes a yoke that is configured to engage a lip portion of the sanitary cover.

15. The bracket assembly of claim 14, wherein the cantilevered arm is removably attached to the sanitary cover with at least one of the fasteners.

16. The bracket of claim 10, further comprising an outer sleeve extending around a portion of the elongated shaft.

17. A method for securing a sanitary cover for the bottom outlet valve to a railcar, comprising the steps of:

securing an upper plate of a bracket assembly to the railcar with at least one fastener, wherein the bracket assembly further includes:

an elongated shaft extending vertically from the upper plate, and a cantilevered arm extending from the elongated shaft near a first proximal portion of the cantilevered arm, wherein the cantilevered arm includes a fastener hole near a second distal portion thereof;

securing the sanitary cover to the cantilevered arm with at least one fastener by:

placing the sanitary cover on the cantilevered arm, and aligning the fastener hole of the cantilevered arm with a fastener hole of the sanitary cover; and inserting one of the fasteners through the aligned fastener holes, wherein the bracket secures the sanitary cover to the railcar when the cover is in use and secured to the bottom outlet valve and when the cover is not is use and not secured to the bottom outlet valve.

18. A bracket assembly for securing to a railcar a cover for a bottom outlet valve of the railcar, comprising:

a bracket attached to the railcar proximate the bottom outlet valve;

a rotational element extending from the bracket; and a cantilevered arm extending from and laterally rotational about the rotational element, wherein the cantilevered arm is mounted to the cover and configured to support the cover when the cover is not secured to the bottom outlet valve, wherein the cover rotates laterally between a use position covering, secured to, and below the bottom outlet valve and a storage position exposing the bottom outlet valve, wherein the cantilevered arm extends from the rotational element near a first proximal portion of the cantilevered arm and mounts to the cover near a second distal portion of the cantilevered arm, and wherein the second distal portion of the cantilevered arm includes a fastener hole adapted to mount the cantilevered arm to the cover.

19. A bracket assembly for securing to a railcar a cover for a bottom outlet valve of the railcar, comprising:

a bracket attached to the railcar proximate the bottom outlet valve;

a rotational element extending from the bracket and including a rod with an outer sleeve that is telescopically extendible and retractable; and a cantilevered arm secured to, extending from, and laterally rotational about the outer sleeve the rod of the rotational element, wherein the cantilevered arm is mounted to the cover and configured to support the cover when the cover is not secured to the bottom outlet valve, wherein the cover rotates laterally between a use position covering, secured to, and below the bottom outlet valve and a storage position exposing the bottom outlet valve.

20. The bracket assembly of claim 19, wherein the rotational element is axially extendible and retractable, wherein when the cover is in the use position the rotational element is retracted and the cover is secured against the bottom outlet valve and in the storage position the rotational element is extended so that the cover is separated from the bottom outlet valve.

* * * * *